United States Patent [19]

Bartell

[11] 3,993,233

[45] Nov. 23, 1976

[54] WEB SLACK BOX HAVING A PLURALITY OF SECTIONS

[75] Inventor: Roger Edwin Bartell, Rochester, N.Y.

[73] Assignee: Eastman Kodak Company, Rochester, N.Y.

[22] Filed: Jan. 16, 1976

[21] Appl. No.: 649,605

[52] U.S. Cl. ..... 226/118; 242/182

[51] Int. Cl.[2] ..... B65H 17/50

[58] Field of Search ..... 226/118, 119; 242/182; 270/79

[56] References Cited

UNITED STATES PATENTS

| | | | |
|---|---|---|---|
| 1,296,476 | 3/1919 | Burnett | 226/118 |
| 2,521,440 | 9/1950 | Bannon | 226/118 |
| 2,808,259 | 10/1957 | Wengel | 226/118 |
| 2,855,196 | 10/1958 | Quirk | 270/79 |
| 3,693,859 | 9/1972 | Nielsen | 226/118 |

*Primary Examiner*—Robert W. Saifer

*Attorney, Agent, or Firm*—S. W. Gremban

[57] ABSTRACT

A slack box for accumulating continuous web material having a plurality of vertically spaced sections separated by movable members. When the amount of web material in a selected one of the sections reaches a predetermined amount, the movable members, starting with the lowest, are sequentially moved from an operative position separating the slack box into sections to an inoperative position thereby allowing web material stored in an upward section to pass or dump into a lower section. After the web material in the uppermost section has been dumped into the adjacent lower section, a web feeding mechanism is actuated to feed a predetermined amount of web material into the uppermost section.

12 Claims, 4 Drawing Figures

10
11
12
14
16
18
20
22
24
26
28
30
38
43
44
45
48
50
51
A
B
C
D
E

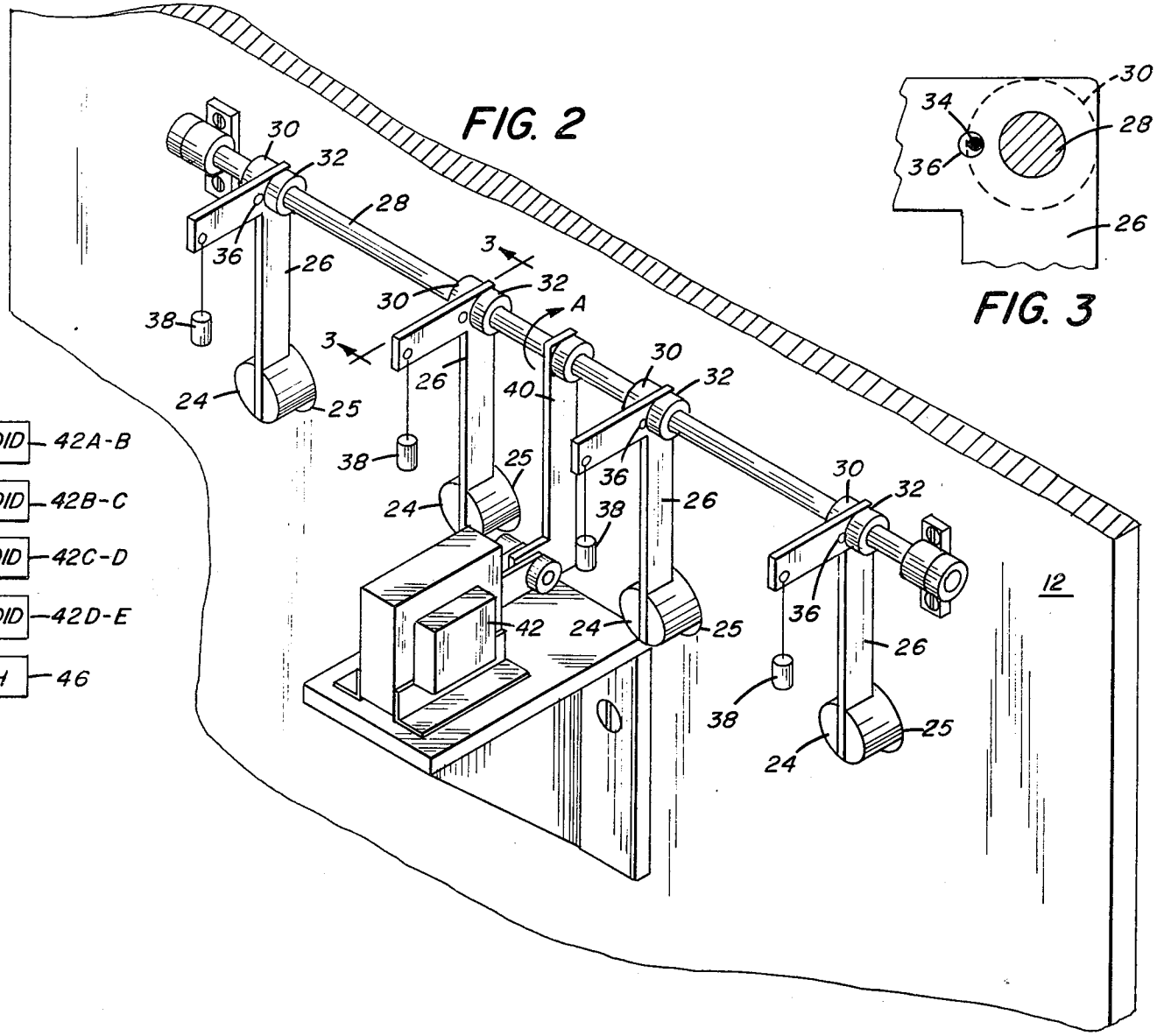
FIG. 3
FIG. 2
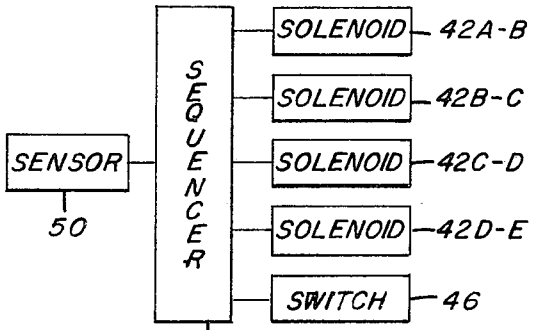
FIG. 4

WEB SLACK BOX HAVING A PLURALITY OF SECTIONS

BACKGROUND OF THE INVENTION

1. Field of the Invention

This invention relates generally to web handling mechanisms, and more specifically to a web slack box having a plurality of sections.

2. Description of the Prior Art

It is known in the prior art to provide slack boxes for storing web material at the feed and take-off ends of a continuously operating machine such as a photographic film processing device. This permits intermittently stopping film transport into or out of the device for short periods of time for some purpose such as inspection, splicing, or the like without affecting the continuous operation of the processing device. One type of slack box for such a machine is shown in German Pat. No. 138,821 comprising one or more solution-filled tanks into which the film is freely randomly fed in serpentine or looped fashion. Such a slack box is not usable in applications in which a dry web is stored or accumulated. Another slack box of this general type receives a freely falling dry web in serpentine or looped fashion, but it is incapable of accumulating a sufficient length of film without crushing the bottom or lower loops of web due to the weight of the upper web loops or convolutions. Another type of slack box, having a rotatable accumulator, is disclosed in U.S. Pat. No. 3,693,859. The slack box comprises a rotatable hub and a plurality of radially extending partitions rotatable therewith and cooperating with a pair of spaced side plates or discs to form a plurality of angularly spaced compartments open at the periphery. The film is fed by a film-feeding mechanism into each of the film compartments in succession as the hub and partitions are rotated by a hub drive mechanism past the film feeding mechanism. The rate of film feed into each compartment and the rotational speed of the hub are selected such that each compartment is substantially filled with film convolutions such as coils and loops of film before the film enters the next succeeding compartment.

Another well-known type of slack box comprises a film supporting elevator mechanism for normally accumulating the film on rollers rotatably mounted on upper and lower spaced apart, parallel shafts. The upper shaft is fixed, and the lower shaft and rollers form a part of a vertically, reciprocally movable elevator mechanism. Accordingly, when the film feed into the processing device is stopped to permit a splicing operation or the like, the elevator mechanism begins to move upwardly as the film continues to be withdrawn from the slack box, and when it reaches a predetermined height, a switch is activated by any suitable means for enabling or actuating the film-feeding mechanism. Since the film is fed into the slack box at a faster rate than it is withdrawn therefrom, the elevator mechanism will then move downwardly as it accumulates film, and when it reaches a predetermined point where sufficient film has been accumulated, it will actuate another switch disabling or deactuating the film-feeding mechanism. Although the elevator slack box operates in a satisfactory manner, it is of relatively complicated construction comprising many parts that greatly increases problems of assembly, operability and repair. Accordingly, such slack boxes are expensive to manufacture, and in addition take up a considerable amount of space. Furthermore, in view of the larger number of rollers and loops involved, the force required to pull the film through the slack box is relatively high.

Still another known type of slack box is disclosed in U.S. Pat. Nos. 2,855,196 and 2,889,491, and in an article entitled "Operational Experience with Seac" by Ernest F. Ainsworth in "The Review of Input and Output Equipment Used in Computing Systems" published by AIEE, Mar. 1953. In this slack box, one or both of the walls of the box is provided with laterally protruding fixed projections extending partially into the box chamber for releasably catching upper web convolutions, thereby preventing crushing of the bottom web convolutions. A disadvantage of this type of slack box is that the projections are fixed and the web convolutions have to be pulled past the projections as the web is fed from the slack box. This results in increasing the inertia of the system and possible web damage due to web deformation or creasing.

SUMMARY OF THE INVENTION

This invention, broadly speaking, concerns a slack box having a plurality of sections for storing continuous web material such as film or the like. The slack box comprises a plurality of vertically spaced sections. Each section is separated from the adjacent sections by a divider comprised of a group or plurality of fingers extending through the back of the slack box. Each group of fingers is pivotally mounted on a common shaft for movement into and out of the slack box. Rotation of the shaft removes the fingers from the slack box allowing web material stored in a section above the group of fingers to pass or drop into a section below the group of fingers. The web material is removed from the bottommost section by any suitable film drive mechanism. In one embodiment, one or more sensors is provided that detects when a predetermined amount of film remains in one of the sections such as the bottommost section and upon detecting this condition, initiates a dumping cycle that provides for sequentially dumping of each section to the next lower section. After the top section has dumped, a web-feeding mechanism is actuated to feed a predetermined amount of web material into the top section. By dividing the slack box into a plurality of sections, it is possible to store a large amount of web material, particularly thin base material, in a given vertical area without causing crushing of bottom web convolutions or loops stored in the slack box, since the load in each section is kept below that which would cause crushing of the bottom loops. Accordingly, slack boxes can be constructed which are of substantially greater capacity than heretofore was possible.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which:

FIG. 2 is an enlarged perspective view of a portion of the back of the slack box of FIG. 1 showing the components of the movable member that divides the slack box into sections.

FIG. 3 is an enlarged sectional view taken along the section line 3—3 of FIG. 2 showing the connection between two components of the movable member; and FIG. 4 is a schematic electrical wiring diagram for the slack box of FIG. 1.

DESCRIPTION OF THE PREFERRED EMBODIMENTS

Figure 1:
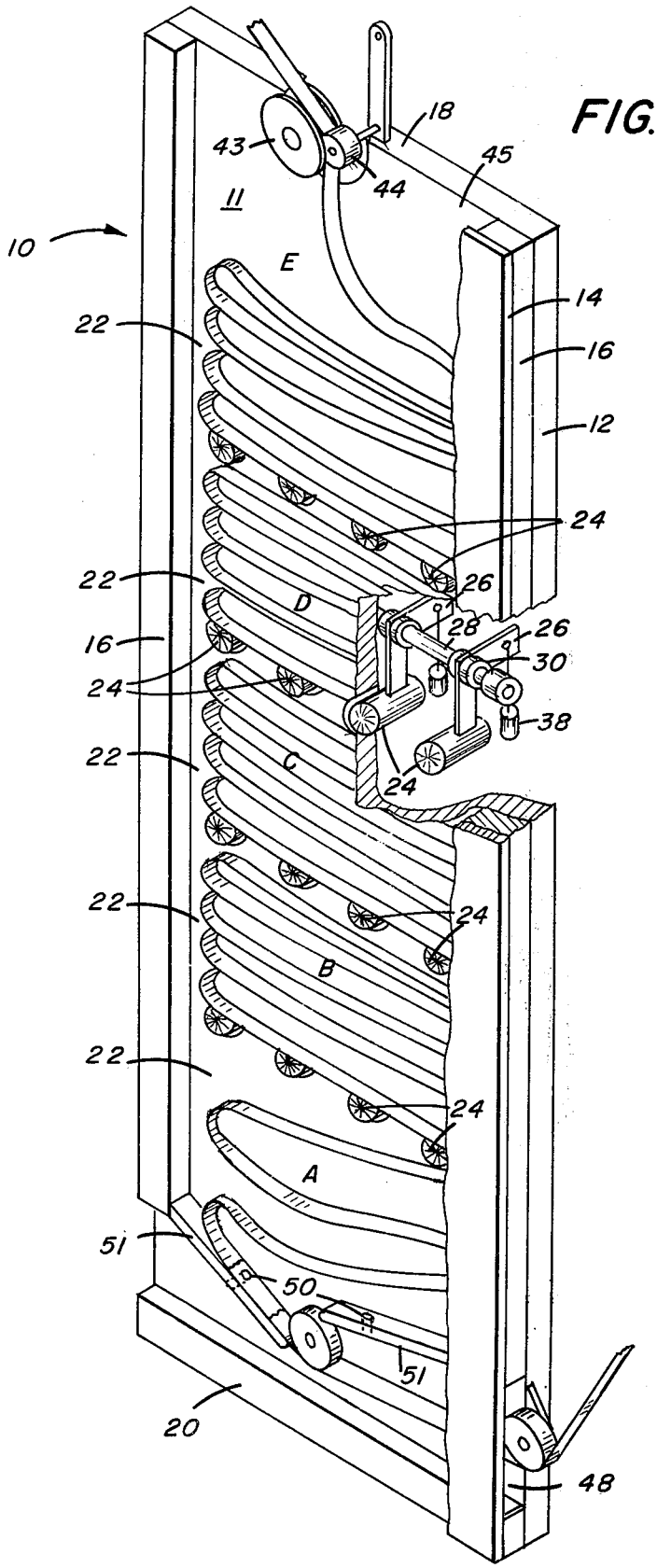
FIG. 1 is a front perspective view, partially cutaway, of one embodiment of a slack box constructed in accordance with this invention.

Because slack boxes are well known, the present description will be directed in particular to elements forming part of, or cooperating more directly with, apparatus in accordance with the present invention. It is to be understood that elements not specifically shown or described may take various forms well known to those skilled in the art.

Referring now to FIG. 1, the components of a slack box constructed in accordance with the present invention are shown. A slack box, generally designated 10, is comprised of a vertical web storage chamber 11 surrounded by a back 12, a front 14, sides 16, a top 18, and a bottom 20. The storage chamber 11 is divided into a plurality of sections 22. The bottom or lowermost section has been designated A, the middle sections have been designated B, C, and D, and the top or uppermost section has been designated E. The size and number of sections 22 is determined by the stiffness of the web material stored in box 10 and the desired storage capacity. Each of the sections 22 is separated from the adjacent sections by a plurality of members, such as hemispherical-tipped fingers 24. The fingers 24, extend through openings 25 in back 12 of box 10. Each finger 24, as shown in FIG. 2, is attached to one end of a generally L-shaped lever arm 26. Each set of lever arms 26 is freely mounted on a common shaft 28 affixed to back 12 for rotational movement around the axis defined by shaft 28. Rotation of shaft 28 moves fingers 24 by virtue of a lost motion connection to be described hereinafter between a normal operative position where they extend into chamber 11 of box 10 and prevent web material in one section to pass into an adjacent lower section, and an inoperative position where they are at least partially removed from chamber 11 and web material in one section is free to pass into the adjacent lower section.

Referring now to FIG. 3, the arrangement including the lost motion connection for mounting lever arms 26 on shaft 28 is shown. Two collars secured to shaft 28, designated 30 and 32 respectively, prevent sideway movement of lever arm 26 on shaft 28. The collar 30 has a laterally extending pin 34 attached thereto which extends parallel to and is spaced apart from shaft 28 and which extends into an oversized hole 36 in lever arm 26. The difference in size between pin 34 and hole 36 allows for lost motion such as a small amount of rotation of shaft 28 without movement of lever arm 26. This small amount of rotation allows one of a group of fingers 24 to remain in an inoperative position when web material is between the end or tip of the finger and the front 14 of box 10. Such lost motion also allows a web convolution, which remains above a finger 24 following a dumping operation to be explained hereinafter, to move the finger to its inoperative position when the web convolution is pulled so that the web convolution can freely pass into the section below the finger.

Pivotal upward movement of a lever arm 40 (secured to shaft 28) in the direction of arrow A, as shown in FIG. 2, rotates shaft 28 and collars 30 and 32 attached in the same direction. As lever arm 40 moves, for instance, under the influence of a solenoid 42, collars 30 rotate and pins 34 attached thereto engage one side of holes 36 causing rotation of lever arms 26. The rotation of lever arms 26 moves fingers 24 from normal operative positions to inoperative positions. Web material retained in one section 22 by fingers 24 is then able to pass by the fingers into the adjacent lower section. After the stored web material has passed into the lower section, shaft 28 is rotated in a direction opposite arrow A to return fingers 24 to their operative positions. Rotation of shaft 28 is accomplished by pivotal downward movement of lever arm 40, spring means (not shown) attached to shaft 28, and/or one or more weights 38 attached to lever arms 26. If the front end or tip of a finger 24 encounters web material as it moves from its inoperative to its operative position, the aforementioned interplay or lost motion between pin 34 and hole 36 allows a momentary halt of movement of finger 24 thereby minimizing damage to the web material. After the web material has passed, the finger 24 moves by virtue of gravity and weight 38 to its operative position. Fingers 24 which do not encounter web material move without interruption from their inoperative positions to their operative positions. Also, such lost motion allows a web convolution, which remains above a finger 24 (between sections A and B for example) following a dumping cycle from section B to section A, to move the finger to its inoperative position when the convolution is pulled so that the convolution can pass into section A without web damage.

A web material feeding mechanism comprising, for example, drive and pinch rollers 43, 44 respectively is rotatably mounted adjacent top 18 of box 10 in spaced relationship to an opening, generally designated 45, in top 18. The mechanism includes a drive motor, not shown, which upon energization by the closure of a switch or other means, generally designated 46, (FIG. 4) feeds a specified or predetermined amount of web material into section E. The amount of web material fed into section E is controlled either by timing the length of time the mechanism is actuated, using a mechanical or photoelectric sensor that detects the amount of web material in section E, or by using other means well known to those skilled in the art. Web material is withdrawn from box 10 by conventional means (not shown) through an opening, generally designated 48, in bottom 20 of box 10. A pair of sensors 50, such as, for example, one or more fluidic or infrared sensors or a mechanical weight-sensitive switch, is mounted within section A near opening 48 and preferably within walls 51 of box 10. The sensors 50 sense the presence or absence of convolutions of web material within section A and generate a signal when the convolutions are absent, which occurs when the amount of web material in section A falls below a predetermined minimum amount. As shown in FIG. 4, the signal generated by sensor 50 energizes a sequencer 52 comprising known integrated circuit timer and position integrated circuit counters which starts a dumping cycle. The dumping cycle comprises energization of sequencer 52 for sequential energization of the solenoids 42 between the various sections. Energization of solenoid 42A-B positioned between sections A and B for a predetermined time period allows dumping of web material from section B into section A and sequential energization of the solenoids 42 between the higher sections designated 42B-C, 42C-D, and 42D-E respectively, sequentially dump each higher section to the next lower section. After the top section has dumped, switch means 46 or the like is activated to energize the web feeding mechanism to feed the predetermined amount of web material into section E.

In operation, sensor 50 senses the absence of a predetermined minimum amount of web material, for example by sensing an empty condition such as the absence of web convolutions in section A and generates a signal to energize sequencer 52. The energization of sequencer 52, as previously explained, starts the dumping cycle. The dumping cycle ends after the predetermined amount of web material has been fed into section E. Since the dumping cycle is started whenever the sensor 50 detects the lack of the predetermined minimum amount of web material in section A, more than one dumping cycle can be in progress at any given time. It should be noted that the rate of the feeding of web material into section E is faster than the rate of withdrawal of web material from section A in order to allow accumulation of web material within box 10. Also, the dumping cycle, once started, continues to completion whether or not web material is still being withdrawn from box 10.

In accordance with an alternative embodiment of the present invention, one or both sensors 50 in section A are replaced with one or more sensors (not shown) in section E. With such an apparatus, web material is continuously fed into section E until the section is full, at which time the sensor(s) generates a signal to actuate a sequencer similar to sequencer 52. The sequencer, starting with section B, sequentially dumps each higher section to a lower section. By providing sensing means in each section 22 or providing logic within the sequencer, dumping of a full upper section to a full lower section is prevented. The web material is intermittently withdrawn from section A at a sufficient rate to prevent overfilling or emptying of slack box 10. Any suitable interlocks may be provided to stop the web being fed into section E in the event of inadvertent overfilling of slack box 10, or to stop the web being withdrawn from the box in the event of inadvertent emptying of the box. Thus, with the slack box of the present invention, web material can be continuously fed and intermittently withdrawn or intermittently fed and continuously withdrawn.

The invention has been described in detail with particular reference to preferred embodiments thereof, but it will be understood that variations and modifications can be effected within the spirit and scope of the invention.

I claim:

1. An improved slack box for accumulating web material comprising:

a vertical web storage chamber;

at least one dividing means for dividing said storage chamber into at least a bottom section and a top section, said dividing means being movable between a normal operative position wherein said dividing means divides said storage chamber into said sections and prevents web material in said top section from passing into said lower section, and an inoperative position wherein said storage chamber is undivided and web material in said top section is free to pass into said lower section;

means for sensing the amount of web material in one of said sections and for generating a signal when the amount of web material in that section reaches a predetermined amount; and means responsive to said signal for moving said dividing means from its operative position to its inoperative position whereby the web material in said top section passes into said bottom section.

2. An apparatus as claimed in claim 1 wherein said sensing means is located in said bottom section and wherein said signal is generated when the amount of web material in said bottom section decreases to said predetermined amount.

3. An apparatus as claimed in claim 2 further comprising:

means, responsive to said signal, for actuating a feeding mechanism to feed a specified amount of web material into said top section, said means being energized after said dividing means has been moved from its operative to its inoperative position; and return means for moving said dividing means to its operative position.

4. An apparatus as claimed in claim 3 further comprising at least an upper and a lower dividing means, said dividing means being spaced apart vertically so as to define upper, middle, and lower sections within said storage chamber.

5. An apparatus as claimed in claim 4 wherein said return means moves said lower dividing means from its inoperative position to its operative position in timed relation to said moving means moving said upper dividing means from its operative position to its inoperative position, said return means moving said lower dividing means to its operative position in time to retain web material released by the movement of said upper dividing means to its inoperative position.

6. An apparatus as claimed in claim 5 wherein said dividing means comprises a plurality of members and said return means further comprises lost motion means for momentarily delaying the movement of one of said members from its inoperative position to its operative position thereby preventing damage to web material positioned in the path of said member upon its movement to its operative position and for allowing any web material above one of said upper and lower dividing means to pass by said one dividing means into the section below.

7. An improved slack box for accumulating web material comprising:

a vertical web storage chamber;

a plurality of dividing means for dividing said storage chamber into a top section, at least one middle section, and a bottom section, each of said dividing means being movable from an inoperative position wherein web material is free to pass from said middle section to said bottom section and from said top section to said middle section, to an operative position separating two sections and preventing web material from one of the two sections from passing to the other of the two sections;

means for sensing the amount of web material in the bottom section and for generating a signal when the sensed amount falls below a predetermined amount;

means responsive to said signal for momentarily moving said dividing means from said operative positions to said inoperative positions, said movement starting with the lowermost dividing means and progressing sequentially to the uppermost dividing means; and return means for moving said dividing means from said inoperative positions to said operative positions to prevent web material in the section above each of said dividing means to pass into the section below each of said dividing means.

8. The apparatus according to claim 7, and further comprising:

a web feeding mechanism for feeding web material into said top section; and means, responsive to said signal, for actuating said web feeding mechanism to feed a specified amount of web material into said top section after the uppermost dividing means separating the top section from the adjacent lower section has been moved to its inoperative position by said first means, said return means moving said uppermost dividing means to its operative position prior to the arrival of said specified amount of web material at said uppermost dividing means.

9. An improved slack box for accumulating a web material comprising:

a housing having a back, a front, two sides, a top, and a bottom;

a vertical web storage chamber within said housing;

a plurality of spaced apart, groups of parallel openings in the back of said housing;

a plurality of shafts rotatably mounted on said housing parallel to and above each of said groups of openings;

a plurality of elements extending through said openings into said housing for dividing said storage chamber into vertical sections, said elements being movable from normal operative positions in which the elements divide said storage area into said vertical sections and prevent web material in one vertical section to pass into a vertical section below to inoperative positions in which the web material in said one section is free to pass into said section below;

lost motion means for mounting said elements on said shafts so as to allow limited movement of said elements independent of movement of said shafts;

first means for rotating each of said shafts, said means, upon actuation, moving said elements from normal operative to inoperative positions;

second means operative after the actuation of said first means for rotating each of said shafts to move said elements from inoperative to operative positions;

means for sensing the amount of web material in a given section and for generating a signal when the amount reaches a predetermined quantity; and means responsive to said signal for sequentially actuating each of said first rotating means, said means actuating the lowermost of said first rotating means first, the actuating of subsequent first rotating means being in timed relation to the operation of said second rotating means.

10. The apparatus according to claim 9 wherein said means for sensing is located in the lowermost of said sections and wherein said predetermined amount is a minimum amount.

11. The apparatus according to claim 10 further comprising:

a web feeding mechanism for feeding web material into the uppermost of said sections in said slack box; and means actuatable after the actuation of the last of said first rotating means for actuating said web feeding mechanism to feed a predetermined amount of web material into said uppermost section.

12. The apparatus according to claim 11 wherein each of said first rotating means comprises a lever secured to said shaft and a solenoid for controlling said lever, said solenoid being actuated by said sequential actuating means to move said lever thereby rotating said shaft.

* * * * *